US011466851B2

(12) United States Patent
Huang et al.

(10) Patent No.: US 11,466,851 B2
(45) Date of Patent: Oct. 11, 2022

(54) SMOKE REMOVAL DEVICE

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 251 days.

(21) Appl. No.: 16/857,736

(22) Filed: Apr. 24, 2020

(65) Prior Publication Data

US 2021/0332978 A1 Oct. 28, 2021

(51) Int. Cl.
*F23J 11/02* (2006.01)
*F24C 15/20* (2006.01)
*F23G 7/06* (2006.01)

(52) U.S. Cl.
CPC ..... *F23J 11/02* (2013.01); *F23G 7/065* (2013.01); *F24C 15/2042* (2013.01); *F23G 7/063* (2013.01); *F23G 2209/14* (2013.01)

(58) Field of Classification Search
CPC combination set(s) only.
See application file for complete search history.

(56) References Cited

U.S. PATENT DOCUMENTS 3,808,987 A * 5/1974 Ehrlichmann ..... F23G 7/065 110/212
4,372,111 A * 2/1983 Virk ..... F01N 3/0231 60/303

(Continued)

FOREIGN PATENT DOCUMENTS

CN 206252968 U 6/2017
CN 206803156 U 12/2017

(Continued)

OTHER PUBLICATIONS

Examination report for TW109104077, dated Jun. 29, 2020, Total of 4 pages.

(Continued)

*Primary Examiner* — Binh Q Tran
(74) *Attorney, Agent, or Firm* — Apex Juris, pllc; Hilde Coeckx

(57) ABSTRACT

A smoke removal device includes a connecting tube, a burner, and a plurality of heat storage meshes. The connecting tube has an inlet end and an outlet end. The burner is disposed in the connecting tube and has a flame outlet. The heat storage meshes are sequentially disposed between the flame outlet and the outlet end. The heat storage meshes includes a first heat storage mesh and a second heat storage mesh. The first heat storage mesh is located between the second heat storage mesh and the flame outlet. A mesh-number of per unit area of the first heat storage mesh is larger than that of the second heat storage mesh. The first heat storage mesh and the second heat storage mesh could slow down a flow rate of flame to increase temperatures of the heat storage meshes. The smoke is burned off once touching the heat storage meshes.

12 Claims, 12 Drawing Sheets

(56) References Cited

U.S. PATENT DOCUMENTS

| | | | | |
|---|---|---|---|---|
| 5,449,288 | A * | 9/1995 | Bass | B05B 7/10 239/434 |
| 6,238,514 | B1 * | 5/2001 | Gu | H01J 37/32844 118/715 |
| 2005/0150220 | A1 * | 7/2005 | Johnson | F01N 11/00 60/297 |
| 2010/0307138 | A1 * | 12/2010 | Chen | F01N 3/0256 60/303 |
| 2011/0197570 | A1 * | 8/2011 | Kalantarifiroozabad | F01N 3/2033 60/303 |
| 2018/0259182 | A1 * | 9/2018 | Silberstein | F23G 5/12 |

FOREIGN PATENT DOCUMENTS

| | | |
|---|---|---|
| TW | 578526 U | 3/2004 |
| TW | M530385 U | 10/2016 |

OTHER PUBLICATIONS

Search report for TW109104077, dated Jun. 29, 2020, Total of 1 page.
English abstract for CN206252968, Total of 1 page.
English abstract for CN206803156, Total of 1 page.
English abstract for TW578526, Total of 1 page.
English abstract for TWM530385, Total of 1 page.

* cited by examiner

SMOKE REMOVAL DEVICE

BACKGROUND OF THE INVENTION

Technical Field

The present invention relates generally to a smoke removal device for an air-exhausting passage, and more particularly to a smoke removal device which removes the smoke by flame.

Description of Related Art

During a process of burning substances of a conventional combustion appliance (e.g. a furnace, a burner, or a coffee bean roaster), microparticles are generated. At the same time, the heat energy supplied by the combustion appliance changes a density of air, thereby to generate an air flow and form a smoke. The microparticles are distributed in the smoke and are discharged from the combustion appliance with the smoke and spreads in an environment. Besides, except the combustion appliance, oil fumes generated during cooking will spread in the environment as well.

The smoke drifting in the environment causes pollution. The microparticles are quite small and light, so that the microparticles are easily spread along with the air flow, thereby to increase a chance to be inhaled by organisms. When respiratory tracts of the organisms are stimulated by these microparticles, a body of the organisms may have uncomfortable reactions.

Take the combustion appliance as an example, the current solution to the above-mentioned problem is to mount a filter cartridge or a filter to a smoke-exhausting path of the combustion appliance, in order to remove the microparticles in the smoke. However, the filter cartridge or the filter needs to be changed regularly to ensure a high-quality filtration, and the cost of filtrating by the filter cartridge or the filter is high, and the filter cartridge or the filter is hard to be replaced, especially difficult in a huge combustion appliance. Therefore, the filter cartridge or the filter is not a preferable or practical way.

A common device for removing the oil fumes is an electrostatic hood, but the effectiveness of removing the oil fumes is limited. When a large amount of oil fumes is emitted, a part of the oil fumes cannot be removed and therefore be discharged.

BRIEF SUMMARY OF THE INVENTION

In view of the above, the primary objective of the present invention is to provide a smoke removal device which is able to effectively remove smoke.

The present invention provides a smoke removal device which is adapted to be disposed on a smoke-exhausting path, including a connecting tube, a burner, and a plurality of heat storage meshes. The connecting tube has an inlet end and an outlet end. A burner is adapted to burn gas to generate flame. The burner is disposed in the connecting tube and has a flame outlet which faces in a direction of the outlet end. The plurality of heat storage meshes is sequentially disposed between the flame outlet and the outlet end in an axial direction of the connecting tube. The plurality of heat storage meshes includes at least one first heat storage mesh and a second heat storage mesh. The at least one first heat storage mesh is located between the second heat storage mesh and the flame outlet.

With the smoke removal device, the smoke could be burned off when the smoke touches the flame. The first heat storage mesh and the second heat storage mesh could slow down the flow rate of the flame and increase the temperature of the heat storage meshes, so that the smoke could be burned off by touching the heat storage meshes, thereby to achieve a good smoke removal effect. Additionally, the odor of the smoke could be eliminated by burning as well.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
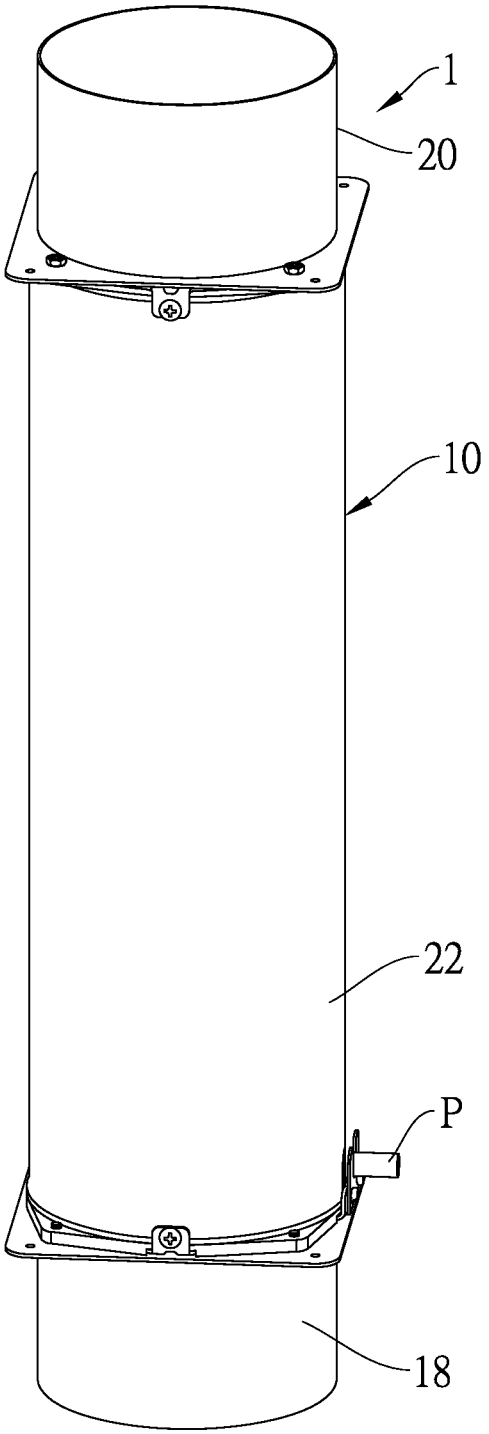
FIG. 1 is a perspective view of the smoke removal device of a first embodiment according to the present invention.
Figure 2:
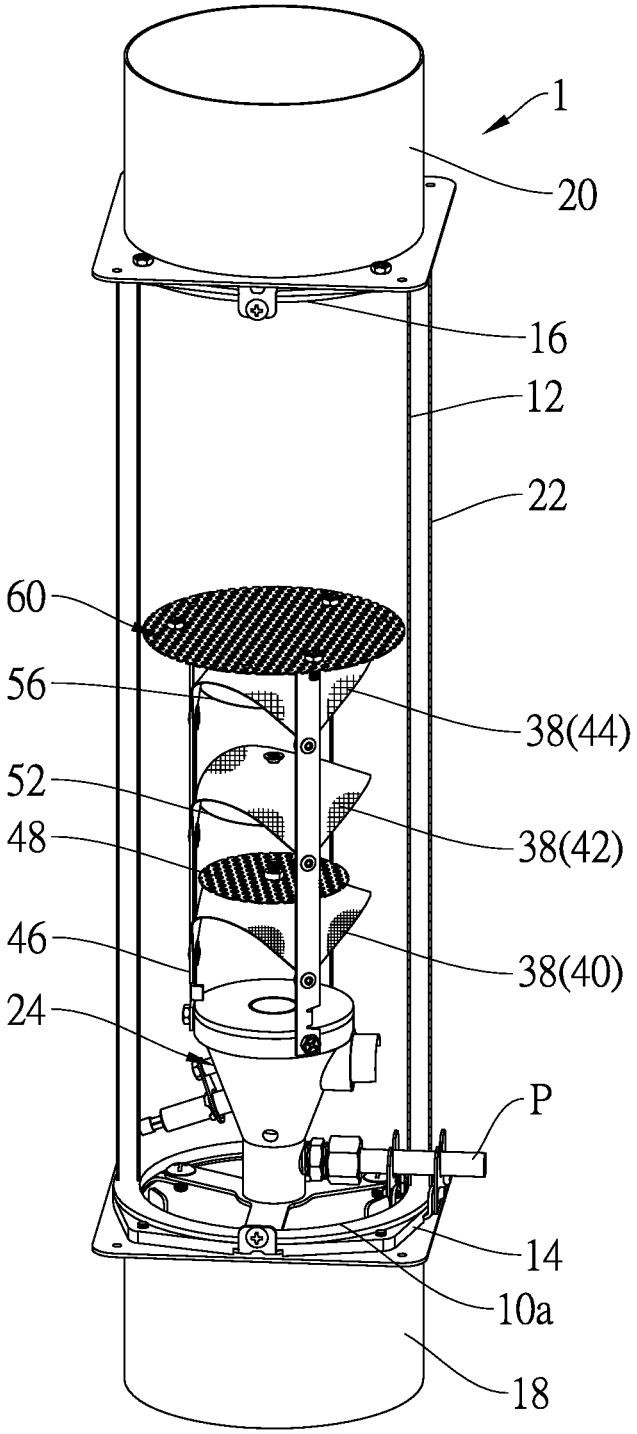
FIG. 2 is a partially sectional view of the smoke removal device of the first embodiment according to the present invention.
Figure 3:
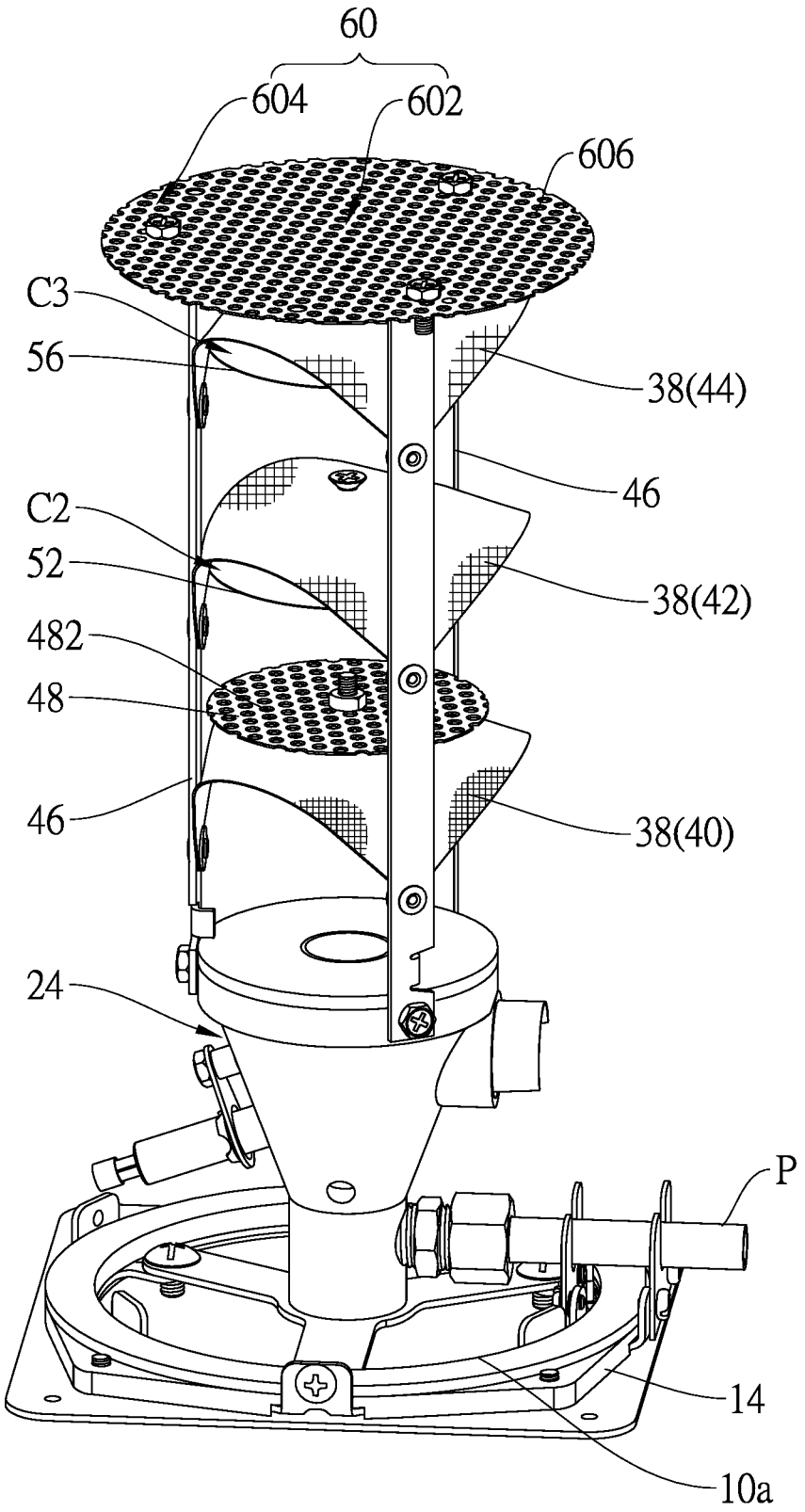
FIG. 3 is a partial perspective view of the smoke removal device of the first embodiment according to the present invention.
Figure 4:
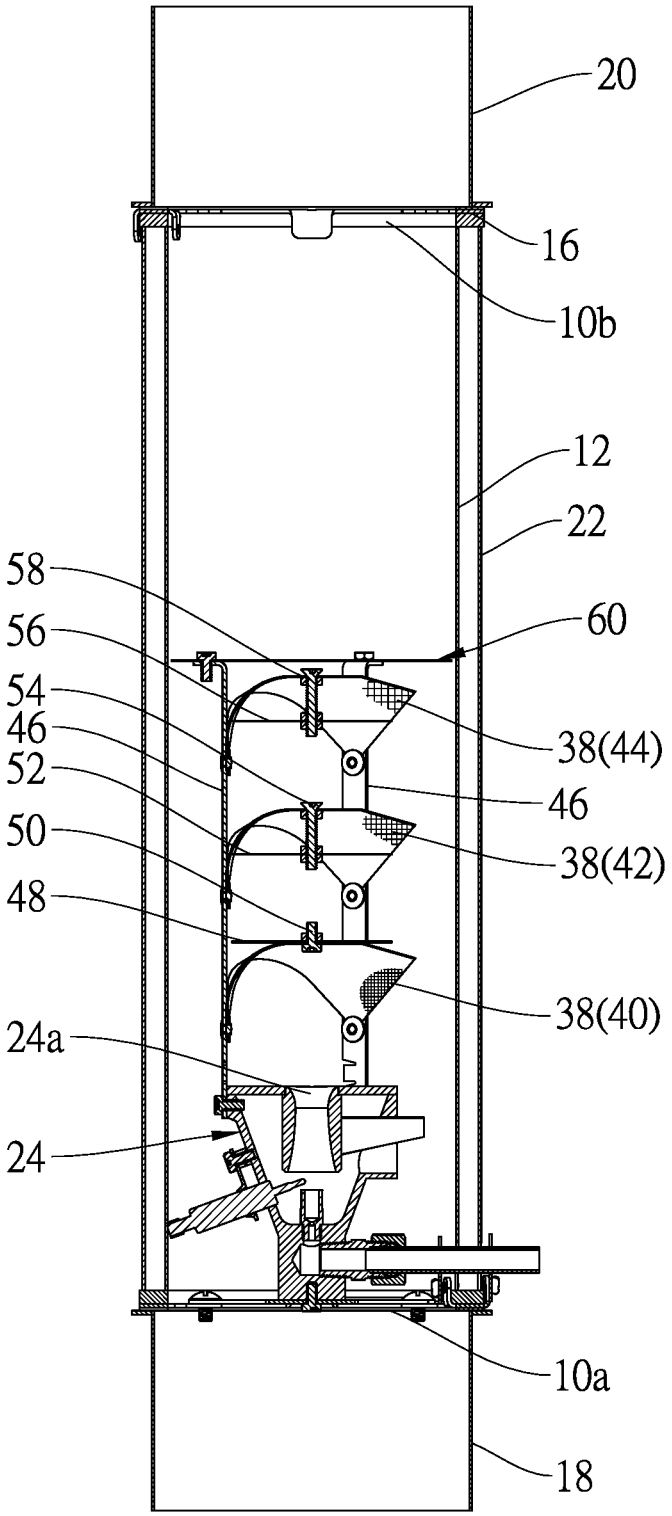
FIG. 4 is a sectional view of the smoke removal device of the first embodiment according to the present invention.
Figure 5:
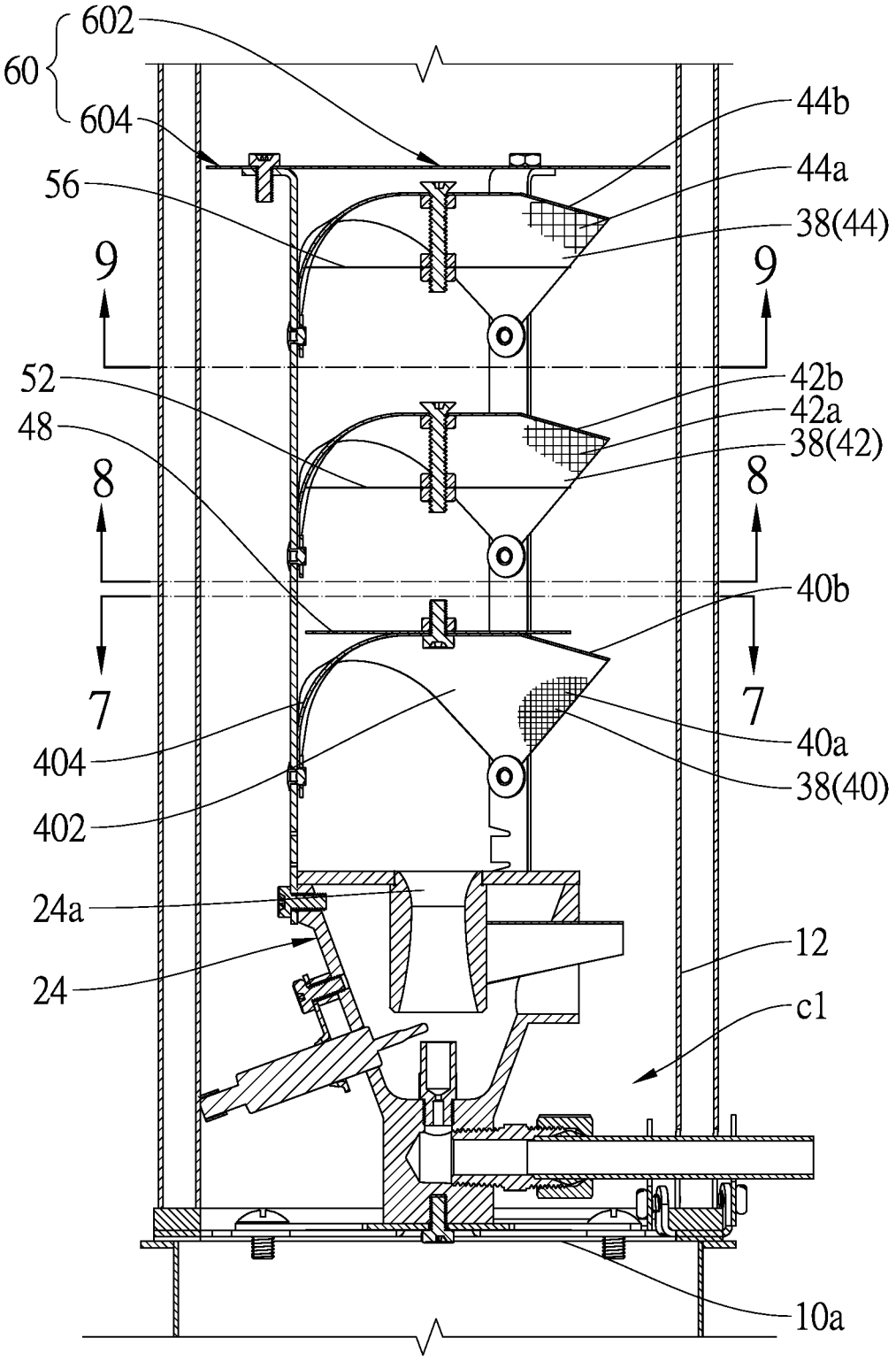
FIG. 5 is a partially sectional view of the smoke removal device of the first embodiment according to the present invention.
Figure 6:
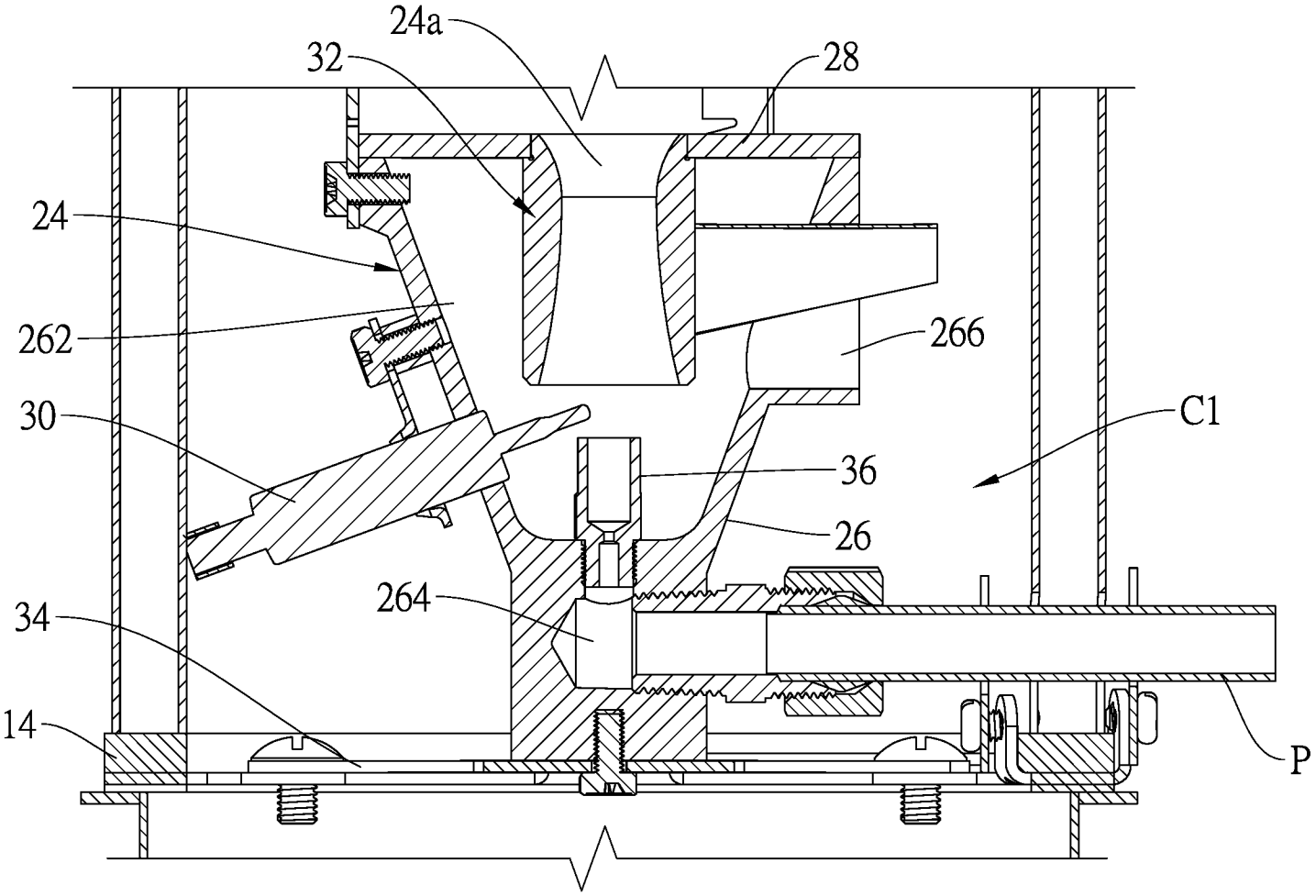
FIG. 6 is a partially sectional view of the burner of the first embodiment according to the present invention.

As illustrated in FIG. 1 to FIG. 9, a smoke removal device 1 of a first embodiment according to the present invention is disposed on a smoke-exhausting path and includes a connecting tube 10, a burner 24, and a plurality of heat storage meshes 38. The smoke-exhausting path could be a smoke-exhausting duct of a combustion appliance or an exhaust hood.

The connecting tube 10 has an inlet end 10*a* and an outlet end 10*b*. More specifically, the connecting tube 10 includes a tube body 12, a first connecting seat 14, and a second connecting seat 16. The first connecting seat 14 has the inlet end 10*a* and is connected to an inlet tube 18. The second connecting seat 16 has the outlet end 10*b* and is connected to an outlet tube 20. An outer surface of the tube body 12 is fitted around by an outer tube 22, wherein a gap is formed between the external tube 22 and the tube body 12.

The burner 24 is disposed in the connecting tube 10, wherein the burner 24 has a flame outlet 24*a* which faces in a direction of the outlet end 10*b*. More specifically, the burner 24 includes a main body 26, a cover plate 28, a Venturi tube 32, and an igniter 30. An end of the main body 26 is disposed on the first connecting seat 14 via a fixing frame 34. The main body 26 is in a cone shape. A periphery surface of the main body 26 corresponds to an inner wall of the tube body 12, and a smoke-exhausting passage C1 is formed between the peripheral surface of the main body 26 and the inner wall of the tube body 12.

The main body 26 has a conical space 262, a gas passage 264, and an air inlet 266. The gas passage 264 communicates the conical space 262 and an external gas pipe P. A nozzle 36 is disposed on an outlet of the gas passage 264. The air inlet 266 is disposed on a lateral side of the main body 26 and communicates the conical space 262 and the smoke-exhausting passage C1. The air inlet 266 is adapted to import primary air from the smoke-exhausting passage C1 to support combustion.

The cover plate 28 is disposed on a top portion of the main body 26. An end of the Venturi tube 32 passes through the cover plate 28 and is disposed with the flame outlet 24*a*. Another end of the Venturi tube 32 faces the nozzle 36. A tube body of the Venturi tube 32 corresponds to the air inlet 266 in a radial direction of the main body 26.

The igniter 30 is engaged with the main body 26, and an igniting end of the igniter 30 is located between the nozzle 36 and the Venturi tube 32. The igniter 30 is adapted to ignite gas outputted from the nozzle 36 to generate flame, and the flame is outputted through the flame outlet 24*a*. In the current embodiment, the igniter 30 is an electric heating rod as an example. The primary air imported via the air inlet 266 is guided by an inner wall of the main body 26 corresponding to the conical space 262 to spin down along the tube body of the Venturi tube 32 and come around the nozzle 36.

The heat storage meshes 38 are sequentially disposed between the flame outlet 24*a* and the outlet end 10*b* in an axial direction of the connecting tube 10. Each two adjacent heat storage meshes 38 are separated by a predetermined distance. In the current embodiment, the heat storage meshes 38 are disposed in the tube body 12 via a plurality of frames 46, wherein an end of each of the frames 46 is connected to the burner 24, and another end of each of the frames extends in a direction toward the outlet end 10*b*. Each of the heat storage meshes 38 is formed by curving a metal mesh (e.g. a ferrochrome aluminum net) and is fixed to the frames 46. However, the heat storage meshes 38 are not limited to a curved shape. Each of the heat storage meshes 38 has an inner surface and an outer surface, wherein the inner surface is a concave surface, and the outer surface is a convex surface. The inner surface faces a direction of the inlet end 10*a*, and the outer surface faces a direction of the outlet end 10*b*.

The heat storage meshes 38 at least include a first heat storage mesh 40 and a second heat storage mesh 42, wherein the first heat storage mesh 40 is located between the second heat storage mesh 42 and the flame outlet 24*a*. A mesh-number of per unit area of the first heat storage mesh 40 is greater than a mesh-number of per unit area of the second heat storage mesh 42. In other words, a density of the first heat storage mesh 40 is greater, and a density of the second heat storage mesh 42 is smaller. In the current embodiment, the heat storage meshes 38 further includes a third heat storage mesh 44, wherein the second heat storage mesh 42 is located between the third heat storage mesh 44 and the first heat storage mesh 40. The mesh-number of per unit area of the second heat storage mesh 42 is greater than a mesh-number of per unit area of the third heat storage mesh 44. In other words, a density of the third heat storage mesh 44 is much smaller. For example, the mesh-number of per unit area of the first heat storage mesh 40 to the third heat storage mesh 44 could be respectively 40-mesh, 36-mesh, and 30-mesh. Practically, the mesh-number of per unit area of the second heat storage mesh 42 could be the same as the mesh-number of per unit area of the third heat storage mesh 44.

In order to illustrate easily, inner surfaces of the first heat storage mesh 40 to the third heat storage mesh 44 are respectively defined as a first inner surface 40*a*, a second inner surface 42*a*, and a third inner surface 44*a*. Outer surfaces of the first heat storage mesh 40 to the third heat storage mesh 44 are respectively defined as a first outer surface 40*b*, a second outer surface 42*b*, and a third outer surface 44*b*.

Figure 7:
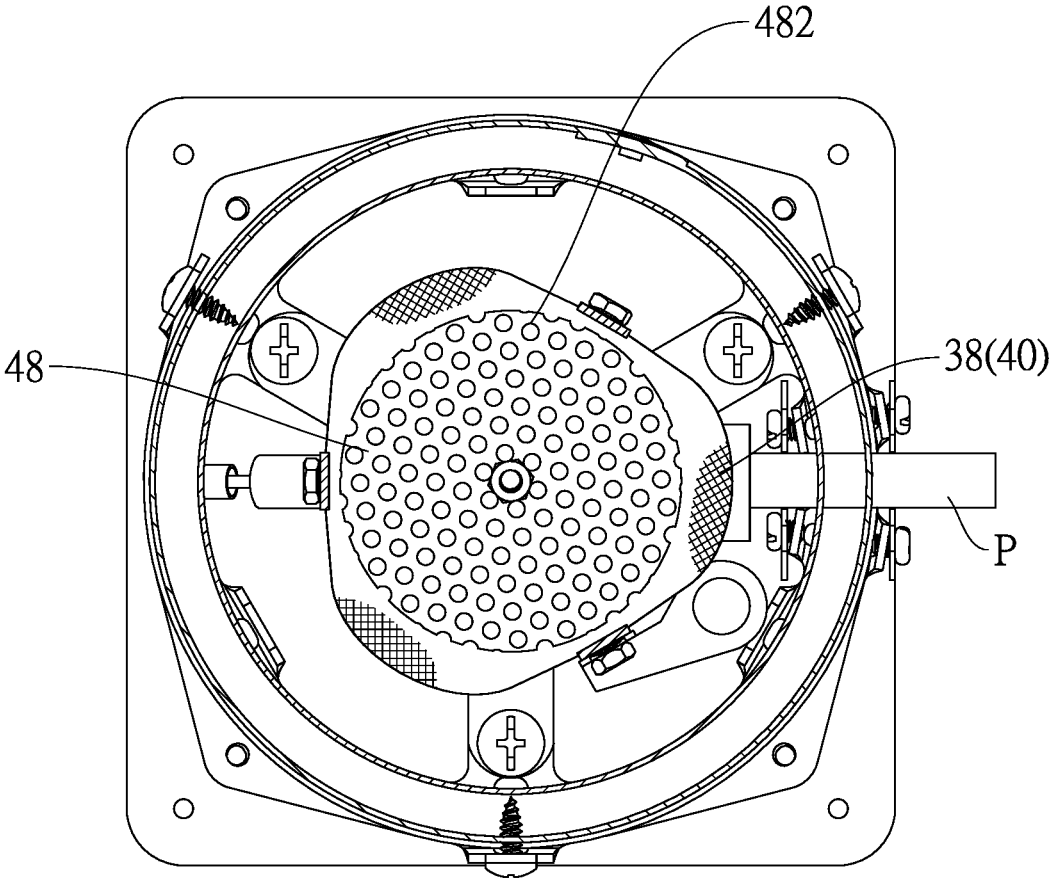
FIG. 7 is a sectional view taken along the 7-7 line in FIG. 5.

The first inner surface 40*a* of the first heat storage mesh 40 corresponds to the flame outlet 24*a* of the burner 24. A flame-guiding plate 48 is disposed on the first outer surface 40*b* and is adapted to divide the flame. The flame-guiding plate 48 is flat and is a circular plate with a plurality of perforations, wherein the perforations is adapted to be passed through by the flame. The flame-guiding plate 48 is fixed to the first heat storage mesh 40 by a fixing member which is a fastening screw 50 as an example. The first heat storage mesh 40 has a central section 402 and a peripheral section 404, wherein the central section 402 corresponds to the flame outlet 24*a*, and the peripheral section 404 surrounds the central section 402. A distance between the first outer surface 40*b* of the first heat storage mesh 40 and the flame-guiding plate 48 is gradually increased in a radial direction from the central section 402 to the peripheral section 404 of the first heat storage mesh 40. Referring to FIG. 7, in the axial direction of the connecting tube 10, a projected area of the flame-guiding plate 48 is smaller than a projected area of the first heat storage mesh 40.

Figure 8:
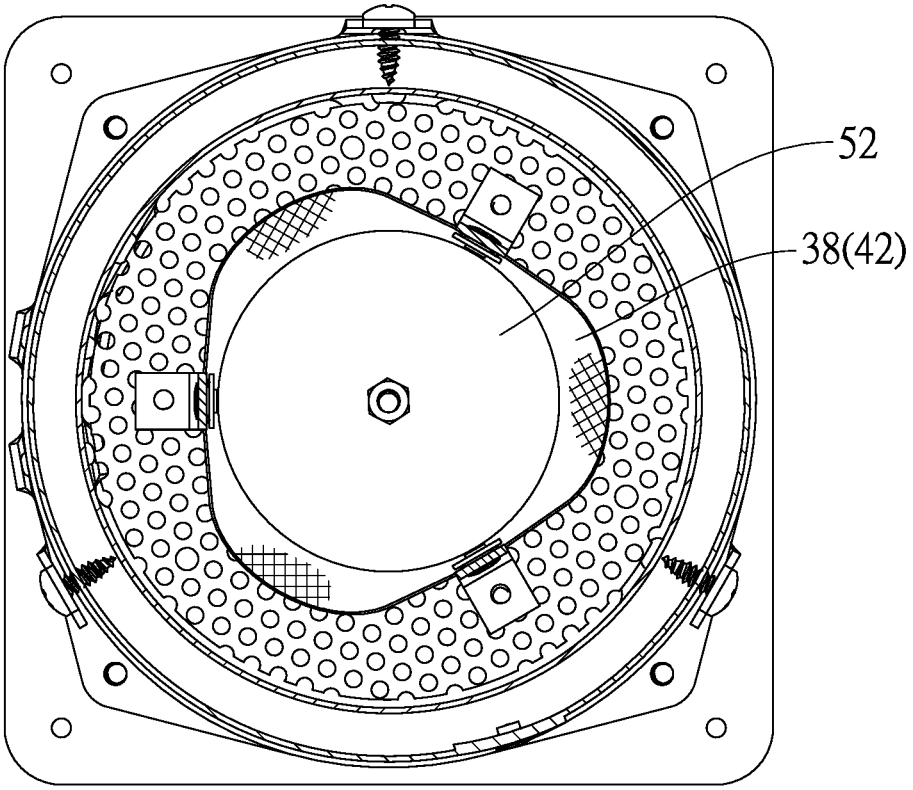
FIG. 8 is a sectional view taken along the 8-8 line in FIG. 5.

The second inner surface 42*a* of the second heat storage mesh 42 is corresponds to the first heat storage mesh 40. A flame-blocking plate 52 is disposed in an area surrounded by the second inner surface 42*a* and is connected to the second heat storage mesh 42. The flame-blocking plate 52 corresponds to the second inner surface 42*a*. In the current embodiment, the flame-blocking plate 52 is fixed to the second heat storage mesh 42 by a fixing member which is a fastening screw 54 as an example. A periphery of the flame-blocking plate 52 is not in contact with the second heat storage mesh 42. A flame passage C2 is formed between a periphery of the second heat storage mesh 42 and the periphery of the flame-blocking plate 52. Referring to FIG. 8, in the axial direction of the connecting tube 10, a projected area of the flame-blocking plate 52 is smaller than a projected area of the second heat storage mesh 42.

Figure 9:
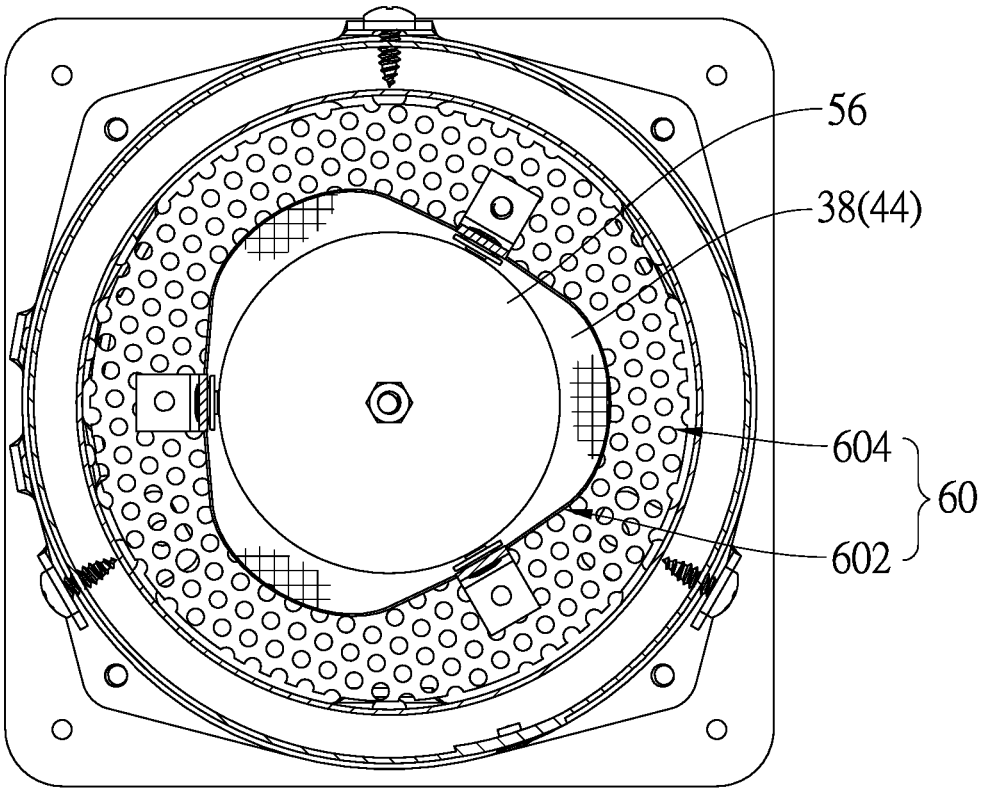
FIG. 9 is a sectional view taken along the 9-9 line in FIG. 5.

The third inner surface 44*a* of the third heat storage mesh 44 corresponds to the second heat storage mesh 42. A flame-blocking plate 56 is disposed in an area surrounded by the third inner surface 44*a* and is connected to the third heat storage mesh 44. The flame-blocking plate 56 corresponds to the third inner surface 44*a*. In the current embodiment, the flame-blocking plate 56 is fixed to the third heat storage mesh 44 by a fixing member which is a fastening screw 58 as an example. A periphery of the flame-blocking plate 56 is not in contact with the third heat storage mesh 44. A flame passage C3 is formed between a periphery of the third heat storage mesh 44 and the periphery of the flame-blocking plate 56. Referring to FIG. 9, in the axial direction of the connecting tube 10, a projected area of the flame-blocking plate 56 is smaller than a projected area of the third heat storage mesh 44.

An end of each of the frames 46 which is away from the flame outlet 24*a* is connected to a flame-guiding plate 60, wherein the third heat storage mesh 44 is located between the second heat storage mesh 42 and the flame-guiding plate 60. A diameter of the flame-guiding plate 60 which is away from the flame outlet 24*a* is larger than a diameter the flame-guiding plate 48 disposed on the first heat storage mesh 40. The flame-guiding plate 60 has a central section 602 and a peripheral section 604, wherein the peripheral section 604 surrounds the central section 602. The another ends of the frames 46 surround the central section 602. A periphery of the flame-guiding plate 60 is adjacent to an inner wall of the tube body 12. The flame-guiding plate 60 has a plurality of perforations 606 which are adapted to be passed through by the flame and are distributed on the central section 602 and the peripheral section 604. In the axial direction of the connecting tube 10, the third heat storage mesh 44 is orthographic projected on the central section 602 of the flame-guiding plate 60 which is connected to the third heat storage mesh 44. A distance between the flame-guiding plate 60 and the third outer surface 44*b* is gradually increased in a radial direction from the central section 602 to the peripheral section 604 of the flame-guiding plate 60.

Figure 10:
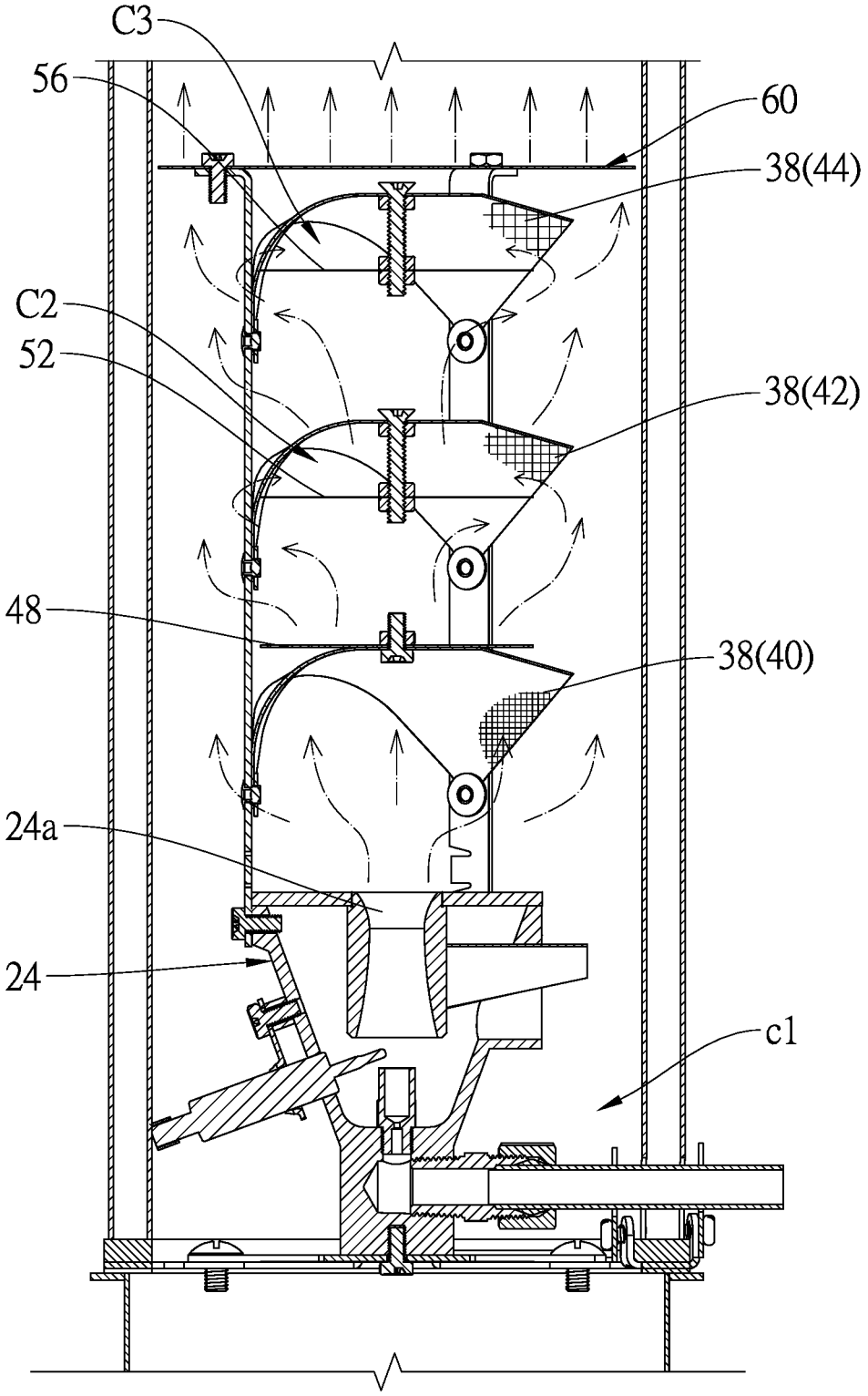
FIG. 10 is a partially sectional view of the smoke removal device, showing the flow direction of the flame.

Referring to FIG. 10, flow directions of the flame are illustrated by dot-dash lines. In order to illustrate easily, take the smoke removal device 1 standing upright as an example. In practice, a direction of setting the smoke removal device is not limited to upright but could be adjusted depending on the required demand After the flame outlet 24*a* of the burner 24 outputs the flame, the flame needs secondary air to burn, so that the air passing through the smoke-exhausting passage C1 corresponding to the main body 26 of the burner 24 is taken into the flame. The smoke is burned by the flame, thereby to decrease residue of the microparticles in the smoke.

With the at least two heat storage meshes 38 (e.g. the first heat storage mesh 40 and the second heat storage mesh 42) which are sequentially arranged from a high density to a low density, the first heat storage mesh 40 could first restrict the flame outputted from the flame outlet 24*a* to make the flame mainly act on the first heat storage mesh 40, so that the first heat storage mesh 40 could accumulate more heat. Then, the flame passes through the first heat storage mesh 40 and comes to the second heat storage mesh 42 to heat the second heat storage mesh 42. Since the density of the second heat storage mesh 42 is lower, the flame would not be excessively restricted to cause unsmooth flow of the flame. In the current embodiment, the third heat storage mesh 44 is further disposed, so that the flame could be further restricted without excessive restriction, which provide a better smoke removal effect than that of two heat storage meshes 38. The heat storage meshes 38 are in a red-hot state after heated by the flame, so that when the smoke touches the heat storage meshes 38, the smoke is burned off.

Since the distance between the first outer surface 40*b* of the first heat storage mesh 40 and the flame-guiding plate 60 is gradually increased from the central section 402 to the peripheral section 404 of the first heat storage mesh 40, a resistance to the flame flowing through the central section 402 of the first heat storage mesh 40 is larger than a resistance to the flame flowing through the periphery section 404 of the first heat storage mesh 40. Therefore, the flame could easily flow through the peripheral section 404 without concentratedly flowing through the central section 402 of the first heat storage mesh 40, thereby to make the flame evenly pass through the perforations 482 of the flame-guiding plate 48.

When the flame flows upwardly to the flame-blocking plate 52, the flame moves upward along the periphery of the flame-blocking plate 52. In other words, the flame-blocking plate 52 could expand the flame, thereby to increase an area that the flame gets in contact with the second heat storage mesh 42. A part of the flame flows upward through the second heat storage mesh 42. Moreover, the flame expanded laterally moves upward through the flame passage C2 formed between the periphery of the second heat storage mesh 42 and the periphery of the flame-blocking plate 52.

When the flame flows upwardly to the flame-blocking plate 56 connected to the third heat storage mesh 44, the flame moves upward along the periphery of the flame-blocking plate 56. In other words, the flame-blocking plate 56 could expand the flame, thereby to increase an area that the flame gets in contact with the third heat storage mesh 44. A part of the flame flows upward through the third heat storage mesh 44 to the central section 602 of the flame-guiding plate 60. Moreover, the flame expanded laterally moves upward through the flame passage C3 formed between the periphery of the third heat storage mesh 44 and the periphery of the flame-blocking plate 56 to the peripheral section 604 of the flame-guiding plate 60. Since the distance between the flame-guiding plate 60 and the third outer surface 44*b* is gradually increased in a radial direction from the central section 602 to the peripheral section 604 of the third heat storage mesh 44, a resistance to the flame flowing through a center of the third heat storage mesh 44 is larger than a resistance to the flame flowing through a periphery of the third heat storage mesh 44. Therefore, the flame could easily flow through the periphery of the third heat storage mesh 44 without concentratedly flowing through the central of the third heat storage mesh 44, thereby to make the flame evenly pass through the perforations 604 of the flame-guiding plate 60 to increase an area that the flame get in contact with the flame-guiding plate 60.

Since the flame-guiding plates 48, 60 and the flame-blocking plates 52, 56 are in a red-hot state after heated by the flame, the smoke could be burned off as well when the smoke touches the flame-guiding plates 48, 60 or the flame-blocking plates 52, 56.

With the smoke removal device according to the present invention, the smoke could be burned off when the smoke touches the flame. Moreover, a flow rate of the flame could be slowed down to increase temperatures of the heat storage meshes, making the heat storage meshes into a glowing state, so that when the smoke touches the heat storage mesh, the smoke could be burned off as well. In this way, the smoke removal device according to the present invention provides a good smoke removal effect, and the odor of the smoke could be eliminated by burning. The flame-guiding plates and the flame-blocking plates could enhance the smoke removal effect.

Figure 11:
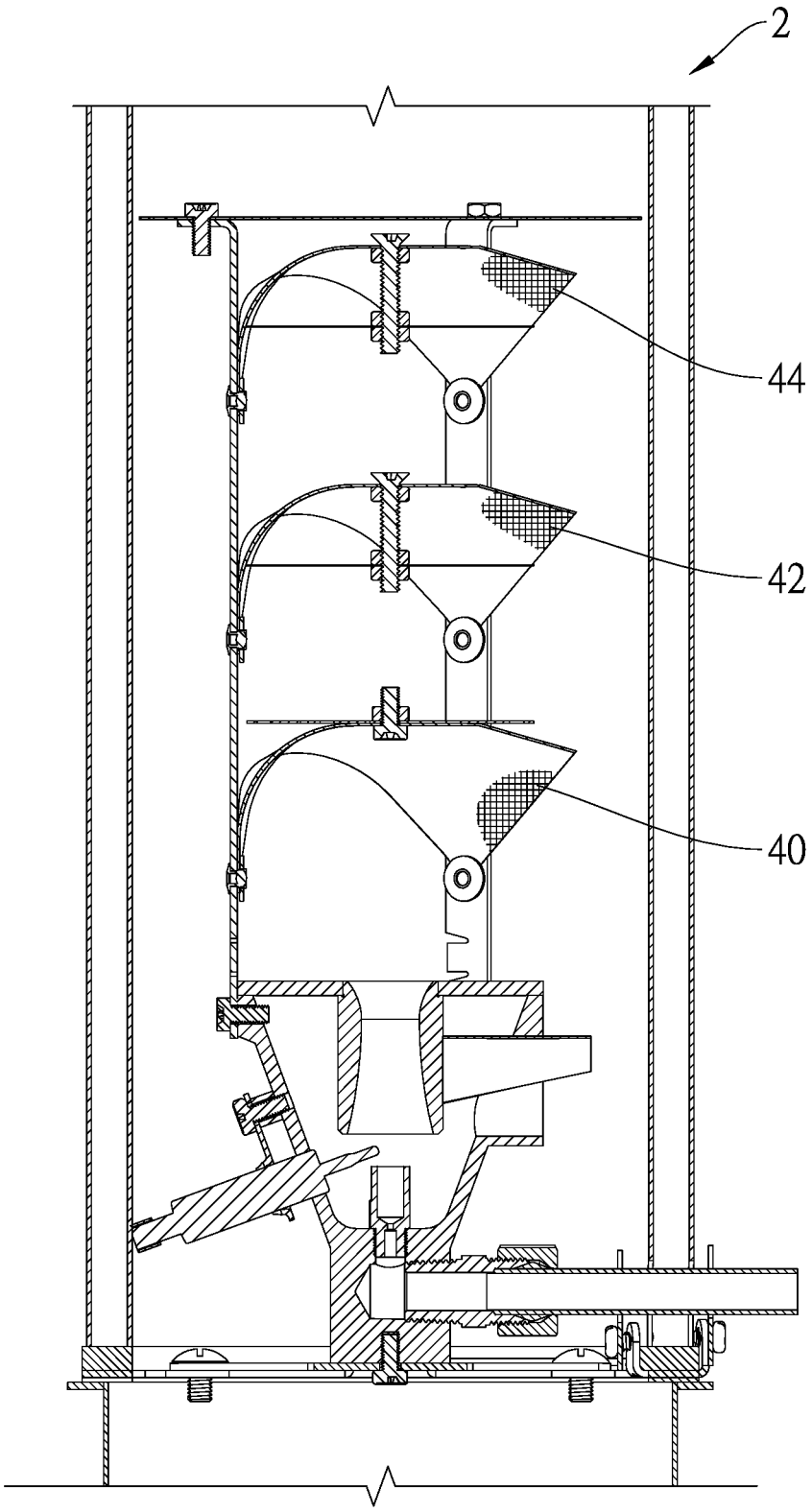
FIG. 11 is a partially sectional view of the smoke removal device of a second embodiment according to the present invention.

As illustrated in FIG. 11, a smoke removal device 2 of a second embodiment according to the present invention has almost the same structure as that of the first embodiment, except that the mesh-numbers of per unit area of the first heat storage mesh 40, second heat storage mesh 42, and the third heat storage mesh 44 are the same (e.g. 40-mesh or 36-mesh). Similarly, the first heat storage mesh 40 and the second heat storage mesh 42 could also slow down the flow rate of the flame.

Figure 12:
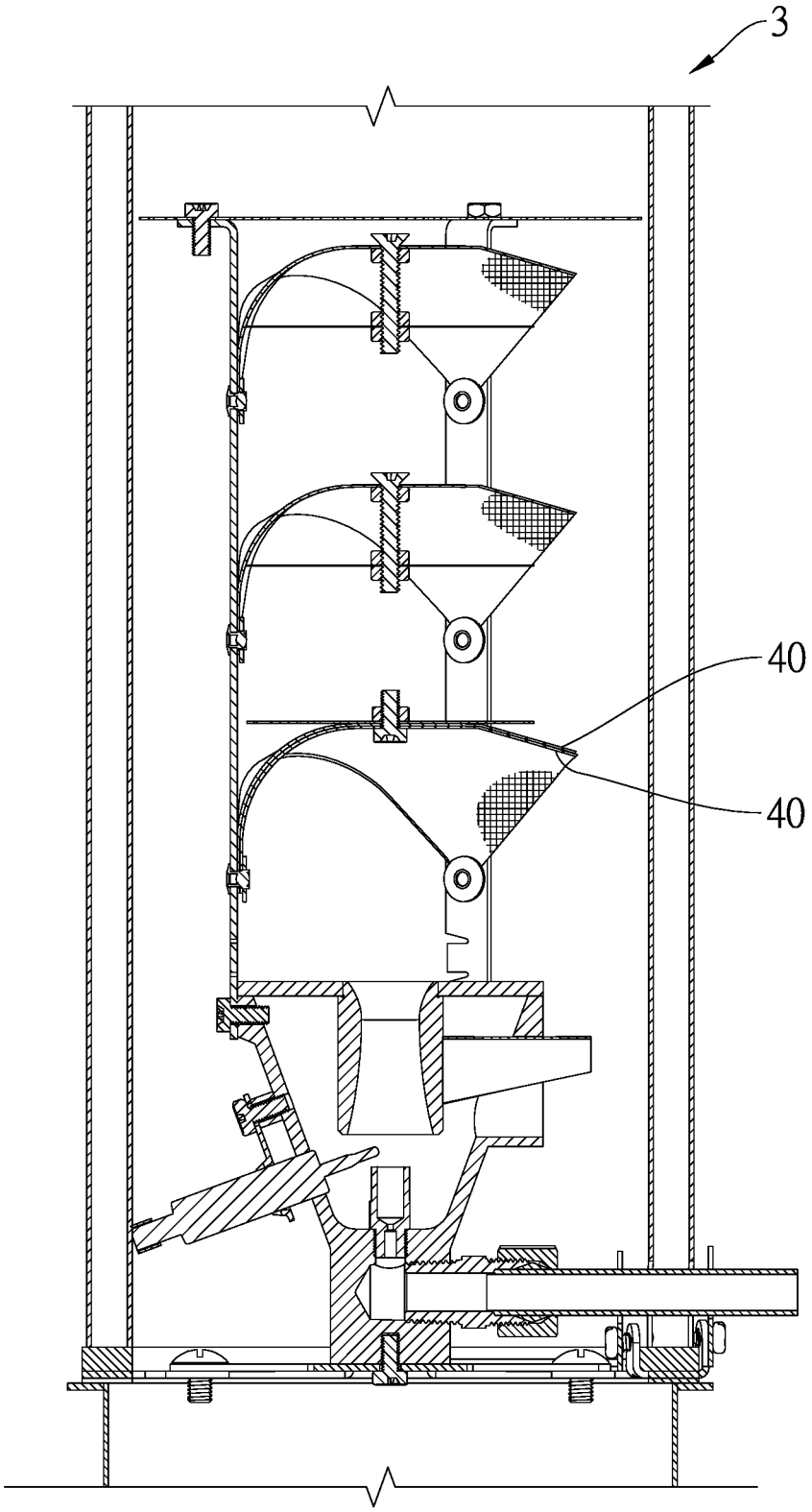
FIG. 12 is a partially sectional view of the smoke removal device of a third embodiment according to the present invention.

As illustrated in FIG. 12, a smoke removal device 3 of a third embodiment according to the present invention has almost the same structure as that of the second embodiment, except that the heat storage meshes 38 includes two first heat storage meshes 40, wherein the mesh-numbers of per unit area of the two first heat storage meshes 40 are the same. The two first heat storage meshes 40 overlap with each other. The flow rate of the flame could be slowed down by the two first heat storage meshes 40 as well.

It must be pointed out that the embodiment described above is only a preferred embodiment of the present invention. All equivalent structures which employ the concepts disclosed in this specification and the appended claims should fall within the scope of the present invention.

What is claimed is:

1. A smoke removal device, which is adapted to be disposed on a smoke-exhausting path, comprising:

a connecting tube having an inlet end and an outlet end;

a burner adapted to burn gas to generate flame, wherein the burner is disposed in the connecting tube and has a flame outlet which faces in a direction of the outlet end;

a plurality of heat storage meshes sequentially disposed between the flame outlet and the outlet end in an axial direction of the connecting tube, wherein the plurality of heat storage meshes comprises at least one first heat storage mesh and a second heat storage mesh, and the at least one first heat storage mesh is located between the second heat storage mesh and the flame outlet; and wherein the at least one first heat storage mesh is spaced from the flame outlet of the burner, and flame outputted through the flame outlet flows along the axial direction of the connecting tube to contact with the at least one first heat storage mesh and the second heat storage mesh.

2. The smoke removal device of claim 1, further comprising a flame-guiding plate which is flat and has a plurality of perforations for being passed through by the flame; the at least one first heat storage mesh has a first inner surface and a first outer surface; the first inner surface is a concave surface and corresponds to the flame outlet; the first outer surface is a convex surface; the flame-guiding plate is disposed on the at least one first heat storage mesh and corresponds to the first outer surface.

3. The smoke removal device of claim 2, wherein the at least one first heat storage mesh has a central section and a peripheral section; the central section corresponds to the flame outlet; a distance between the first outer surface of the at least one first heat storage mesh and the flame-guiding plate is gradually increased from the central section to the peripheral section of the at least one first heat storage mesh.

4. The smoke removal device of claim 3, further comprising a flame-blocking plate, wherein the second heat storage mesh has a second inner surface and a second outer surface; the second inner surface is a concave surface and corresponds to the at least one first heat storage mesh; the second outer surface is a convex surface; the flame-blocking plate is connected to the second heat storage mesh and corresponds to the second inner surface.

5. The smoke removal device of claim 4, wherein in the axial direction of the connecting tube, a projected area of the flame-blocking plate is smaller than a projected area of the second heat storage mesh; a flame passage is formed between a periphery of the second heat storage mesh and a periphery of the flame-blocking plate.

6. The smoke removal device of claim 4, wherein the plurality of heat storage meshes further comprises a third heat storage mesh; the second heat storage mesh is located between the third heat storage mesh and the at least one first heat storage mesh.

7. The smoke removal device of claim 6, further comprising another flame-blocking plate, wherein the third heat storage mesh has a third inner surface and a third outer surface; the third inner surface is a concave surface and corresponds to the second heat storage mesh; the third outer surface is a convex surface; the another flame-blocking plate is connected to the third heat storage mesh and corresponds to the third inner surface.

8. The smoke removal device of claim 7, wherein in the axial direction of the connecting tube, a projected area of the another flame-blocking plate is smaller than a projected area of the third heat storage mesh; another flame passage is formed between a periphery of the third heat storage mesh and a periphery of the another flame-blocking plate.

9. The smoke removal device of claim 6, further comprising another flame-guiding plate and a plurality of frames, wherein an end of each of the plurality of frames is connected to the burner, and another end of each of the frames is connected to the another flame-guiding plate; the another flame-guiding plate is flat and has a plurality of perforations for being passed through by the flame; the third heat storage mesh is located between the second heat storage mesh and the another flame-guiding plate; the another flame-guiding plate has a central section and a peripheral section; the another ends of the plurality of frames surround the central section; in the axial direction of the connecting tube, the third heat storage mesh is orthographic projected on the central section of the another flame-guiding plate; the plurality of perforations of the another flame-guiding plate are distributed on the central section and the peripheral section of the another flame-guiding plate.

10. The smoke removal device of claim 9, wherein a distance between the another flame-guiding plate and the third outer surface is gradually increased in a radial direction from the central section to the peripheral section of the another flame-guiding plate.

11. The smoke removal device of claim 1, wherein a mesh-number of per unit area of the at least one first heat storage mesh is larger than a mesh-number of per unit area of the second heat storage mesh.

12. The smoke removal device of claim 1, wherein the at least one first heat storage mesh comprises two first heat storage meshes, and mesh-numbers of per unit area of the two first heat storage meshes are the same; the two first heat storage meshes overlap with each other.

* * * * *